United States Patent [19]

Bradt

[11] Patent Number: 4,672,349

[45] Date of Patent: Jun. 9, 1987

[54] COIL FORM WITH INTEGRAL COMB-LIKE FINS ON AT LEAST ONE END FLANGE

[75] Inventor: Peter Bradt, Ganderkesee, Fed. Rep. of Germany

[73] Assignee: Siemens Aktiengesellschaft, Fed. Rep. of Germany

[21] Appl. No.: 845,908

[22] Filed: Mar. 28, 1986

[30] Foreign Application Priority Data

Mar. 29, 1985 [DE] Fed. Rep. of Germany ..... 8509589

[51] Int. Cl.[4] ..... H01F 15/10

[52] U.S. Cl. ..... 336/192; 174/94 R

[58] Field of Search ..... 174/94 R; 336/192, 198, 336/208; 310/194, 71

[56] References Cited

U.S. PATENT DOCUMENTS

| | | | |
|---|---|---|---|
| 2,802,193 | 8/1957 | Biba, Jr. et al. | 336/192 X |
| 3,189,857 | 6/1965 | Jones | 336/192 X |
| 3,330,903 | 7/1967 | Holke et al. | 174/94 R |
| 3,359,520 | 12/1967 | Foerster | 336/192 |
| 3,405,379 | 10/1968 | Wilson | 336/192 |
| 3,517,377 | 6/1970 | Olsson | 174/94 R X |
| 3,701,961 | 10/1972 | Folk | 336/192 |
| 3,760,339 | 9/1973 | Marshall | 336/192 X |
| 3,781,459 | 12/1973 | Peek | 174/94 R |
| 3,848,208 | 11/1974 | Dawson et al. | 336/192 X |
| 3,963,857 | 6/1976 | Reynolds et al. | 336/192 X |

FOREIGN PATENT DOCUMENTS

| | | | |
|---|---|---|---|
| 239912 | 11/1960 | Australia | 336/192 |
| 2455046 | 5/1976 | Fed. Rep. of Germany | 336/192 |
| 3236345 | 5/1984 | Fed. Rep. of Germany . | |
| 1439993 | 4/1966 | France | 336/192 |

*Primary Examiner*—Thomas J. Kozma

*Attorney, Agent, or Firm*—Volker R. Ulbrich; Jack R. Penrod

[57] ABSTRACT

This invention concerns a coil form with integral comb-like fins at least on one end, between which contact elements are placed that can be connected with the winding ends of the windings. Each contact element is held by the fastening grooves of two adjacent fins. In order that all connecting points can be made in the same, universal fashion, independent of the wire diameter of the individual winding leads, the contact elements are provided with a "U"-shaped receiving channel running parallel to the coil form axis. This receiving channel can be closed by a cover and can be ultrasonic welding to the walls of the receiving channel and to the winding ends inserted therein.

9 Claims, 4 Drawing Figures

COIL FORM WITH INTEGRAL COMB-LIKE FINS ON AT LEAST ONE END FLANGE

FIELD OF THE INVENTION

This invention relates to the field of electrical coils and more particularly to a coil form with integral comb-like fins between which metallic contact elements are placed for connection with electrical leads.

BACKGROUND OF THE INVENTION

A known coil form is described in German Offenlegungsschrift No. 32 36 345. In this known coil form, flat contact elements are inserted parallel to the axis of the coil form in fastening grooves provided on the fins. The contact elements are provided with a clamping slot, into which the respective winding ends are inserted for connection. The width of each clamping slot must be adapted to the wire diameter of the corresponding winding end. Thus. if the wire lead diameters are different, differently made contact elements are required.

SUMMARY OF THE INVENTION

It is an object of this invention to create a coil form in which all connecting points are made in the same fashion, independent of the wire diameter of the individual winding leads and connection leads. Briefly stated in accordance with one aspect of the invention, the aforementioned object is achieved by providing the contact elements each provided with a "U"-shaped receiving channel or groove running parallel to the longitudinal axis of the coil form, which can be closed by a cover which can be attached by ultrasonic welding to the walls of the receiving channel and to the winding leads inserted thereinto. Winding leads differing in diameter can be inserted into the receiving channel. Simultaneously with the leads of the coil winding, a connecting wire leading outward can be inserted so that the external connection is created at the same time as the winding leads.

By one end of the receiving channel having an integral mounting clip that can be inserted into one of the fastening grooves running perpendicularly to the longitudinal axis of the coil, the contact elements can be inserted in the spaces between fins from above, in the same direction as the winding leads. This is particularly advantageous for automatic fabrication, since the position of the coil form need not be altered.

The contact elements can be made in a one-piece form suitable for automatic fabrication if a foldable tab is made integrally as a cover on at least one side wall of the receiving channel. The folding of the tab functioning as a cover is preferred if said tab is connected to the side wall by means of one or more webs, or also if a notched groove is made at the transition between the side wall and the tab.

By clamping tabs, serving to relieve the tension on the wires to be connected, being provided on the contact elements in an axial extension of the receiving channel, the clamping tabs can be clinched and thus a means of tension relief created by ultrasonic welding in one single operation.

The contact elements can also be made for other ways of connecting the external connecting wires. Plug-in or solder connections are possible if a connecting lug or a connecting pin is integrated on the contact elements in an axial extension of the receiving channel.

BRIEF DESCRIPTION OF THE DRAWINGS

While the specification concludes with claims particularly pointing out and distinctly claiming the subject matter which is regarded as the invention, it is believed that the invention will be better understood from the following description of the preferred embodiment taken in conjunction with the accompanying drawings in which:

DESCRIPTION OF A PREFERRED EMBODIMENT

Figure 1:
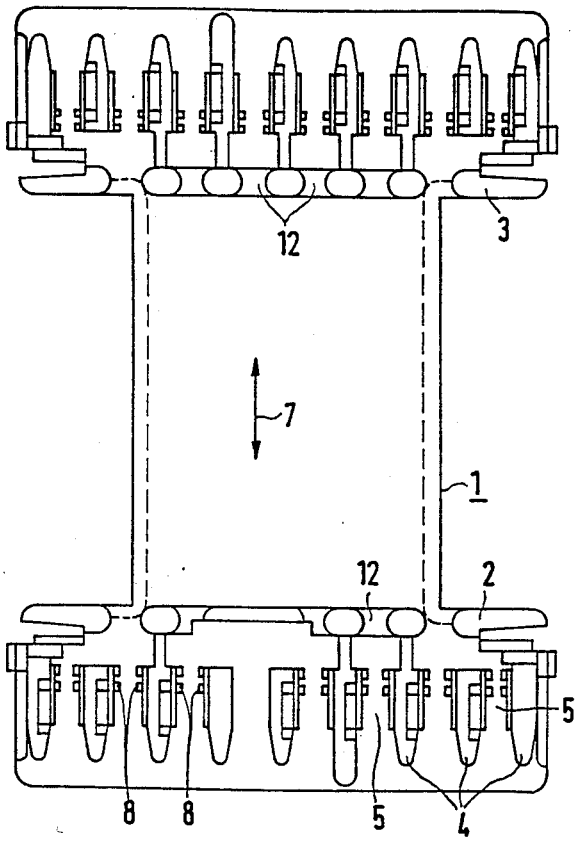
FIG. 1 shows a top view of the coil form.
Figure 2:
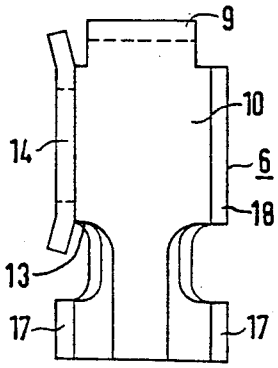
FIG. 2 shows a top view of an individual contact element.

The number 1 denotes a coil form shown without windings. On the end flanges 2 and 3 of the coil form 1, fins 4 are integrally formed by standard manufacturing methods. Contact elements 6 can be inserted in the individual spaces 5 between the fins. Fastening grooves 8 are furnished on the fins transversely, that is perpendicularly to the coil form axis 7 so that the contact elements 6 can be mounted; a mounting clip 9 provided on the contact element 6 can be inserted in said fastening grooves 8.

Each contact element 6 exhibits a "U"-shaped receiving channel 10. When the contact element 6 is in the installed position on the coil 1, the receiving channel 10 runs parallel to the coil axis 7. In this way, the winding ends 11 of the coil can be easily inserted. The winding ends 11 need only be pulled outward through appropriate slots 12 in the end flange 2 or 3, thus reaching directly into the receiving channel 10 of the contact element 6.

The electrical connection and also the mechanical connection of the winding ends 11 with the contact element 6 are made by ultrasonic welding of a tab 14 provided as a cover on one of the side walls 13. In order to make this tab 14 easy to bend, said tab is connected to the corresponding side wall 13 only by narrow webs 15. Instead of the webs 15, a notch-shaped groove can also be provided which results in a hinge action. After the insertion of the winding ends 11 and of an external connecting wire 16, if applicable, the tab 14 is folded over the receiving channel 10 and connected by ultrasonic welding to the wires lying in the receiving channel 10 and to the side walls 13 and 18 of the receiving channel 10.

In order to relieve the mechanical tension forces on the end of the external connecting wire 16 that is inserted in the receiving channel 10, clamping tabs 17 are provided on the contact element 6; said clamping tabs are pressed onto the external connecting wire 16 and thus mechanically hold said external connecting wire.

If the external connections are to be made only at the subsequent point of use of the coil form, the contact elements 6 can be provided with appropriate connecting elements, for example with a plug connector lug or with a solder pin. The plug lug or the solder pin can by made integrally on the contact element 6.

Figure 3:
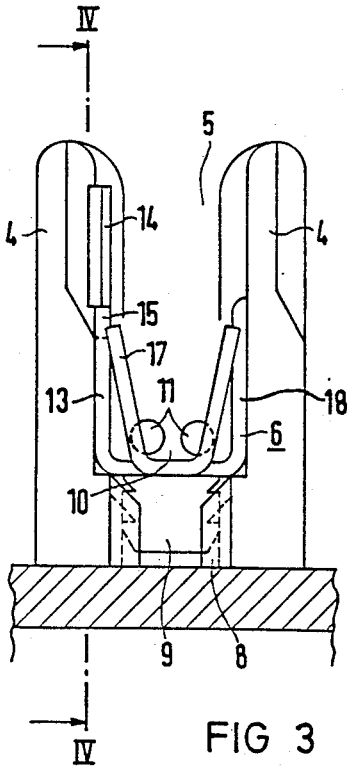
FIG. 3 shows, in an exploded front view, a contact element inserted between two fins of the end flange of the coil form.
Figure 4:
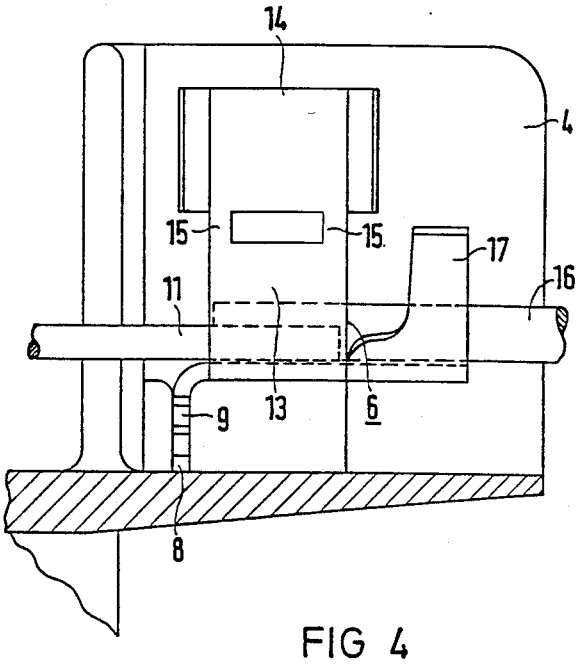
FIG. 4 shows a section taken along the line IV—V of FIG. 3.

As FIG. 3 further shows the lateral edges of the mounting clips 9 are made in a toothed form, so that a kind of ratchet action is achieved between the mounting clips 9 and the fastening grooves 8. The contact elements 6 are thus held very securely in the fastening grooves 8. Since the mounting clips 9 are inserted in the fastening grooves 8 transversely to the coil form axis 7, the contact elements 6 can also withstand even strong tensile loads.

It will now be understood that there has been disclosed an improved system for coil form with integral comb-like fins which has a universal contact element at each connection point. As will be evident from the foregoing description, certain aspects of the invention are not limited to the particular details of the examples illustrated, and it is therefore contemplated that other modifications or applications will occur to those skilled in the art. It is accordingly intended that the claims shall cover all such modifications and applications as do not depart from the true spirit and script of the invention.

What is claimed as new and desired to be secured as Letters Patent of the United States is:

1. A coil form having at least one end flange with integral comb-like fins, between which there are fastening grooves into which metallic contact elements are placed so as to be connectable with ends of a winding, each such contact element being held in the fastening grooves of two adjacent comb-like fins, wherein each contact element has a "U"-shaped receiving channel oriented parallel to a longitudinal axis of the coil form, and a hinged cover of single-piece construction with said channel between said fins and each said receiving channel is adapted to be closed by its respective cover which can be ultrasonically welded to a side wall of each receiving channel and to a winding lead inserted thereinto.

2. A coil form according to claim 1, wherein one end of the receiving channel has an integral mounting clip which can be inserted into the fastening grooves which run perpendicularly to the longitudinal axis of the coil form.

3. A coil form according to claim 1, wherein said cover is a foldable tab on at least one side wall of the receiving channel.

4. A coil form according to claim 2 wherein the cover is a foldable tab on at least one side wall of the receiving channel.

5. A coil form according to claim 3, wherein the tab is connected to said side wall by means of at least one web.

6. A coil form according to claim 4, wherein the tab is connected to said side wall by means of at least one web.

7. A coil form according to claim 3, wherein a notch-shaped groove is made at the transition between said side wall and said tab.

8. A coil form according to claim 4, wherein a notch-shaped groove is made at the transition between said side wall and said tab.

9. A coil form according to claim 1, wherein clamping tabs, serving to relieve the tension on wires to be corrected, are provided on the contact elements in an axial extension of the receiving channel as axial extensions of said receiving channel.

* * * * *